US007121677B2

(12) United States Patent
Huang

(10) Patent No.: US 7,121,677 B2
(45) Date of Patent: Oct. 17, 2006

(54) ELECTRIC TORCH

(75) Inventor: Shou Chen Huang, Taipei (TW)

(73) Assignee: Kingwell Products Inc., Taipei (TW)

( * ) Notice: Subject to any disclaimer, the term of this patent is extended or adjusted under 35 U.S.C. 154(b) by 31 days.

(21) Appl. No.: 10/940,662

(22) Filed: Sep. 15, 2004

(65) Prior Publication Data

US 2006/0028809 A1 Feb. 9, 2006

(30) Foreign Application Priority Data

Aug. 3, 2004 (TW) ..... 93212283 U

(51) Int. Cl.
*F21L 4/00* (2006.01)
*F21L 4/04* (2006.01)

(52) U.S. Cl. ..... 362/157; 362/197; 362/198; 362/202

(58) Field of Classification Search ..... 362/202, 362/157, 203, 188, 197, 198
See application file for complete search history.

(56) References Cited

U.S. PATENT DOCUMENTS 4,777,582 A * 10/1988 Sharrah ..... 362/205
4,951,183 A * 8/1990 Wang ..... 362/187
5,499,172 A * 3/1996 Shiau ..... 362/187
6,004,008 A * 12/1999 Lai ..... 362/280
6,074,072 A * 6/2000 Parsons et al. ..... 362/202
6,170,960 B1 * 1/2001 Maglica ..... 362/205
6,347,878 B1 * 2/2002 Shiao ..... 362/157
6,398,383 B1 * 6/2002 Huang ..... 362/202
6,682,203 B1 * 1/2004 Shiau ..... 362/202
6,726,342 B1 * 4/2004 Lai ..... 362/188
2001/0024367 A1 * 9/2001 Shiau ..... 362/188
2005/0207148 A1 * 9/2005 Maglica ..... 362/197
2006/0039139 A1 * 2/2006 Maglica et al. ..... 362/202

* cited by examiner

*Primary Examiner*—John Anthony Ward
*Assistant Examiner*—David Makiya
(74) *Attorney, Agent, or Firm*—Rosenberg, Klein & Lee

(57) ABSTRACT

An electric torch includes a bulb holder, a head and a body. The bulb holder includes a bulb housing and a bulb received in the bulb housing, with a pair of first and second electrically conductive terminals. The first electrically conductive terminal is ground by a file to form a recessed portion and the first electrically conductive terminal is easily bent at the recessed portion. The head includes a head housing with a first thread segment at the upper outside surface and the lower inside surface, a reflector housing fixed to the upper portion of the bulb housing with and an arcuate reflecting concave at the upper inside and a through hole defined in the center of the reflecting concave for extension of the bulb.

18 Claims, 4 Drawing Sheets

ELECTRIC TORCH

BACKGROUND OF THE INVENTION

1. Field of the Invention

The present invention relates to an electric torch, and particularly to an electric torch which prevents a bulb thereof from adversely affecting during assembly and ensures the bulk at the focus of a reflecting concave after assembly.

2. Prior Art

An electric torch is one daily article for lighting. Particularly when power cut takes place in house, no power is supplied to outside at night, or the army or the police works at night, the electric torch is a necessary tool for lighting. The electric torch has a bulb which includes two electrically conductive terminals parallelly and outwardly extending from the bulb. In assembly of the electric torch, the two electrically conductive terminals are directly inserted into two metallic sockets for electrical connection. However, the bulb is easy to fall off, particularly when the electric torch is fixed to a gun for shooting lighting. To encounter the above problem, one of the two terminals is bent to connect to a body of the electric torch thereby preventing the bulb from falling off. However, when the electrically conductive terminal of the bulb is bent with a bending force, micro-splits may occur between the electrically conductive terminal and a glass shell of the bulb at the periphery of the terminal whereby the airtight between the terminals and the glass shell is adversely affected or even damaged. Since vacuum is configured in the shell, air will gradually flow into the shell through the micro-splits. So a filament of the bulb is easy to oxygenize when the filament generates high heat whereby the bulb burns out immediately or the working life of the bulb is shortened.

Furthermore, the bulb is preferred to locate at the focus of a reflecting concave of a reflector of the electric torch. The reflector is rotatable to adjust the position relationship between the bulb and the reflector thereby placing the bulb at the focus of the reflecting concave. However, the reflector is easily rotated during use, which changes the position relationship between the reflector and the bulb. Therefore the bulb is easy to leave the focus of the reflecting concave which adversely affecting the lighting of the electric torch. To encounter the above problem, a user may adjust the reflector to place the bulb at the focus again. However, it is inconvenient to adjust the reflector during use. Particularly, when the army or the police uses the electric torch for work, it is time consuming to adjust the reflector to place the bulb at the focus, which may result in losing a good chance or even danger. Moreover, a common user cannot professionally adjust the reflector to place the bulb at the focus which reducing the lighting effect of the electric torch.

Additionally, when the electric torch falls down or is fixed to a gun for shooting lighting, a battery of the electric torch tends to quickly move relative to the body of the electric torch due to the acceleration of gravity or the recoil of shooting and so the battery is exerted with an external force. However, since the central portion of a negative pole of the battery is extremely thin, the negative pole is readily recessed due to the external force, which results in poor electrical contact between the bulb and the battery.

Therefore, it is required to improve the conventional electric torch.

SUMMARY OF THE INVENTION

Accordingly, an object of the present invention is to provide an electric torch which can prevent micro-splits from occurring at a bulb of the electric torch during assembly.

Another object of the present invention is to provide an electric torch which has a bulb fixed at the focus of a reflecting concave of the electric torch thereby preventing the bulb from leaving the focus for convenient use.

Further object of the present invention is to provide an electric torch which has a recessed annulus abutting against the peripheral portion of a negative pole of a battery of the electric torch thereby preventing the negative pole from being recessed and so preventing the battery from being in poor electrical connection with a bulb.

To achieve the above-mentioned objects, an electric torch in accordance with the present invention includes a bulb holder, a head and a body. The bulb holder includes a bulb housing and a bulb received in the bulb housing. The bulb includes a first electrically conductive terminal and a second electrically conductive terminal. A recessed portion is formed at the first electrically conductive terminal whereby the first electrically conductive terminal is easily bent at the recessed portion. The head includes a head housing which includes a first thread segment at the upper outside surface thereof and a thread segment at the lower inside surface thereof, a reflector housing fixed to the upper portion of the bulb housing and abuttingly received in the head housing, and a head cover. The reflector housing has an arcuate reflecting concave at the upper inside thereof. A through hole is defined in the center of the reflecting concave for extension of the bulb. An inner thread segment is formed at the upper portion of the head cover for engaging with the first thread segment of the head housing. The body has a base comprising an outer thread segment at the upper portion thereof for engaging with the thread segment of the head housing. An upper receiving chamber is defined in the upper portion of the base. A conductive member is received in the bottom of the upper receiving chamber for electrically connecting with a battery in the base.

Other objects, advantages and novel features of the present invention will be drawn from the following detailed embodiments of the present invention with attached drawings, in which:

DESCRIPTION OF THE PREFERRED EMBODIMENT

Figure 1:
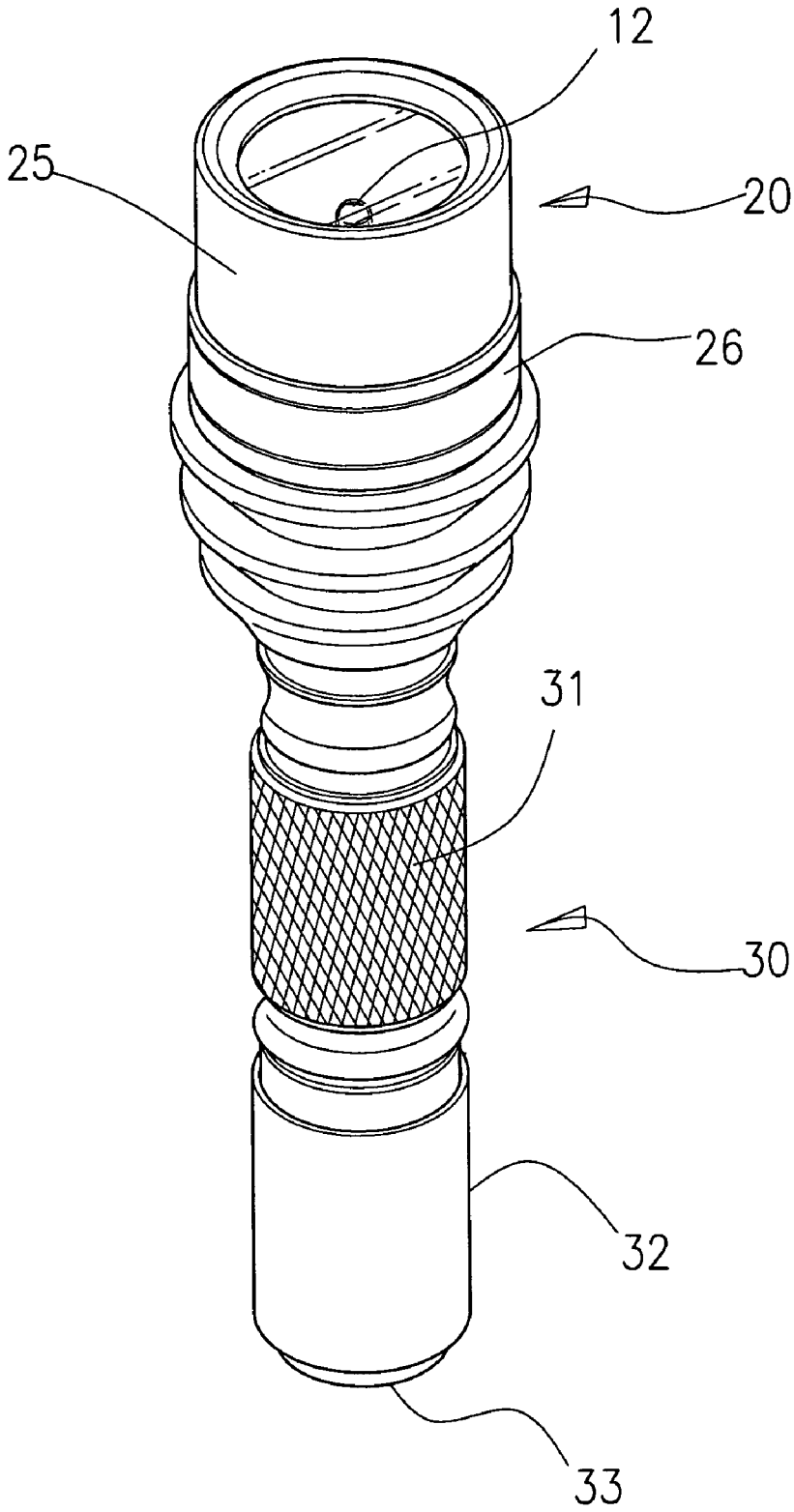
FIG. 1 is a perspective view of an electric torch of the present invention.
Figure 2:
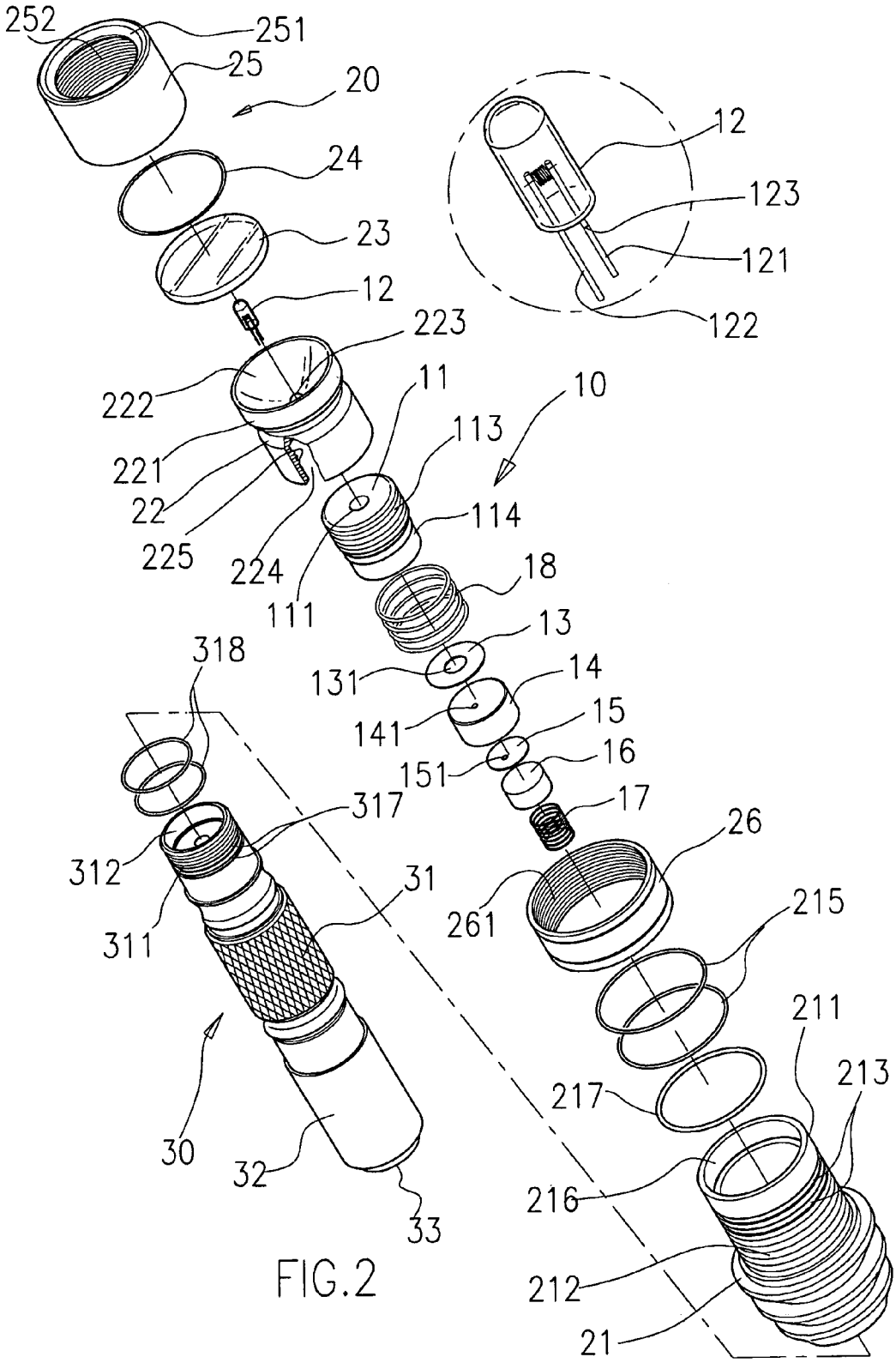
FIG. 2 is an exploded view of FIG. 1.
Figure 3:
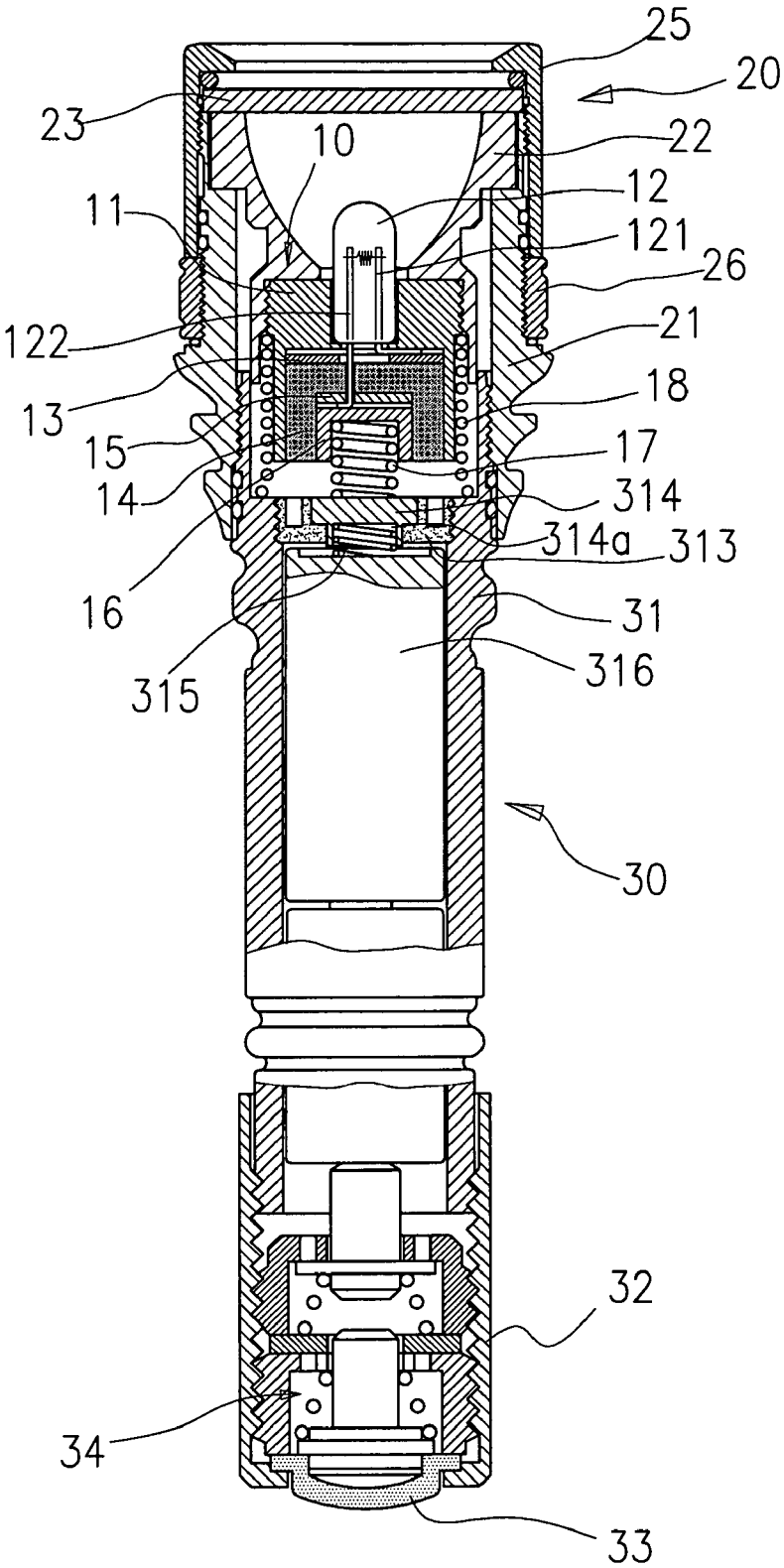
FIG. 3 is a cross-sectional view of FIG. 1.
Figure 4:
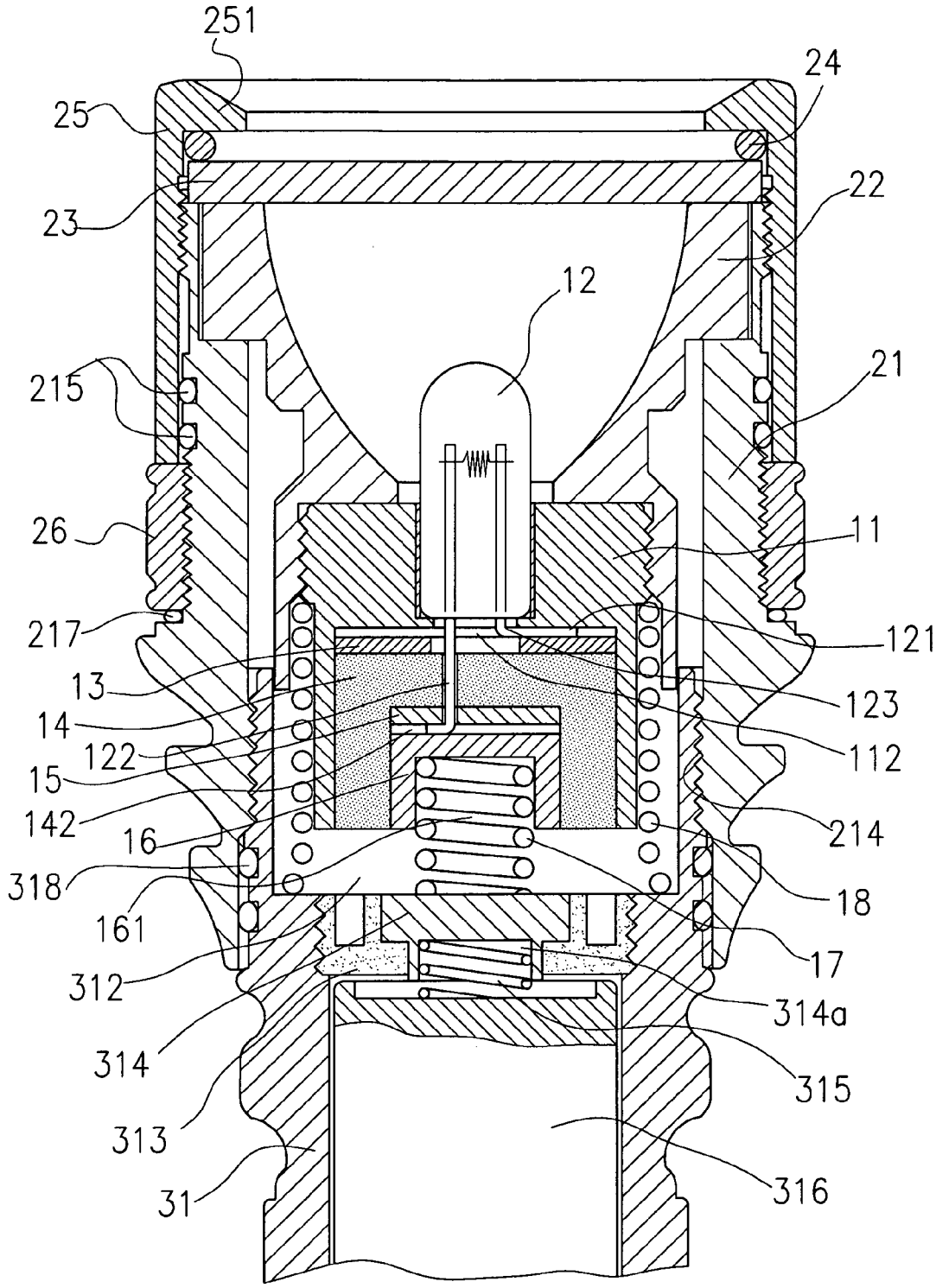
FIG. 4 is a partially enlarged view of FIG. 3.

Referring to FIGS. 1–4, an electric torch of the present invention includes a bulb holder 10, a head 20 and a body 30. The bulb holder 10 includes a bulb housing 11, a bulb 12, an annular metal plate 13, an insulative sleeve 14, a conductive metal plate 15, an inner metal sleeve 16, an inner spring 17 and an outer spring 18. A bulb hole 111 and a bulb housing receiving chamber 112 in communication to the bulb hole 111 are respectively defined in the bulb housing 11 (see FIG. 4). The bulb housing 11 includes a thread segment 113 disposed at the top of the outer surface thereof and a recessed segment 114 disposed at the bottom of the outer surface thereof. The bulb 12 has two electrically conductive terminals 121, 122. A recessed portion 123 is defined in the electrically conductive terminal 121 through grinding the electrically conductive terminal 121 with a file. The recessed portion 123 is generally a triangular cutout with a bottom angle about 90 degrees. A through hole 131 is defined in the annular metal plate 13. The diameter of the through hole 131 is larger than the width between the two electrically conductive terminals 121, 122. An eccentric hole 141 and a sleeve receiving chamber 142 in communication to the eccentric hole 141 are respectively defined in the insulative sleeve 14 (see FIG. 4). An eccentric hole 151 is defined in the conductive metal plate 15. An inner sleeve receiving chamber 161 is defined in the inner metal sleeve 16.

In assembly of the bulb holder 10, the bulb 12 is received in the bulb hole 111 of the bulb housing 11 with the two electrically conductive terminals 121, 122 thereof extending into the bulb housing receiving chamber 112 of the bulb housing 11. The electrically conductive terminal 121 is bent at the recessed portion 123. The annular metal plate 13 is inserted into the bulb housing receiving chamber 112 with the electrically conductive terminal 122 extending through the through hole 131 thereof and being not in contact with the annular metal plate 13. The annular metal plate 13 abuts against the bent electrically conductive terminal 121. The insulative sleeve 14 is then inserted into the bulb housing receiving chamber 112 with the electrically conductive terminal 122 extending through the eccentric hole 141 and into the sleeve receiving chamber 142. The conductive metal plate 15 is then inserted into the sleeve receiving chamber 142 with the electrically conductive terminal 122 extending through the eccentric hole 151 and then being bent. The inner metal sleeve 16 is then received in the sleeve receiving chamber 142 and abuts against the bent terminal 122. The inner sleeve receiving chamber 161 of the inner metal sleeve 16 receives the inner spring 17 whereby the inner metal sleeve 16 resiliently abuts against the bent electrically conductive terminal 122.

The head 20 includes a head housing 21, a reflector housing 22, a transparent shield 23, a waterproof ring 24, a head cover 25 and a positioning annulus 26. The head housing 21 is generally a hollow tube. A first thread segment 211, two annular recesses 213 and a second thread segment 212 are formed at the upper outside surface of the head housing 21. A thread segment 214 is formed at the lower inside surface of the head housing 21 (see FIG. 4). Two waterproof rings 215 are respectively received in the two annular recesses 213. An abutting chamber 216 with a relatively large inside diameter is defined in the upper portion of the head housing 21. The reflector housing 22 includes an abutting annulus 221 at the upper outside thereof and an arcuate reflecting concave 222 at the upper inside thereof. A through hole 223 is defined in the center of the reflecting concave 222. An engaging chamber 224 is defined in the lower inside of the reflector housing 22 in communication to the through hole 223. An inner thread segment 225 is disposed at the engaging chamber 224. The transparent shield 23 and the waterproof ring 24 are disposed at the top of the reflector housing 22. The head cover 25 includes an annular flange 251 inwardly extending from the top thereof and an inner thread segment 252 formed at the inside surface thereof. The positioning annulus 26 is formed with an inner thread segment 261.

The body 30 includes a base 31. The base 31 includes an outer thread segment 311 at the top thereof. An upper receiving chamber 312 is defined in the upper portion of the base 31. Two annular recesses 317 are defined in the outer surface of the base 31. A recessed annulus 313 is threadedly fixed to the lower portion of the upper receiving chamber 312. A metallic conductive member 314 is positioned at the center of the recessed annulus 313 (see FIG. 4). A receiving chamber **314*a* is defined in the lower center of the conductive member 314 and receives a spring 315 therein for electrically conductive connection with a battery 316 in the base 31. The outside diameter of the upper portion of the spring 315 is slightly larger than the inside diameter of the receiving chamber 314*a* thereby securing the spring 315 in the receiving chamber 314*a*. Each annular recess 317 receives a waterproof ring 318 therein. A lower sleeve 32 is threadedly fixed to the bottom of the base 31. The lower sleeve 32 cooperates with a button 33 and a resilient pressing mechanism 34 to form a rotating switch (see FIG. 3). The resilient pressing mechanism 34** is conventional and so is not detailedly described herein.

In assembly of the bulb holder 10, the head 20 and the body 30, the thread segment 113 of the bulb housing 11 threadedly engages with the inner thread segment 225 of the engaging chamber 224 of the reflector housing 22. The bulb holder 10 and the reflector housing 22 are received in the head housing 21 with the abutting annulus 221 of the reflector housing 22 abutting against the abutting chamber 216 of the head housing 21 and with the thread segment 214 of the head housing 21 threadedly engaging with the outer thread segment 311 of the base 31. The outer spring 18 resiliently abuts between the thread segment 113 of the bulb housing 11 and the upper receiving chamber 312 of the base 31. The inner thread segment 261 of the positioning annulus 26 threadedly engages with the second thread segment 212 of the head housing 21. One waterproof ring 217 abuts between the positioning annulus 26 and the head housing 21. The transparent shield 23 is positioned on the reflector housing 22. The head cover 25 covers the transparent shield 23 with the inner thread segment 252 thereof threadedly engaging with the first thread segment 211 of the head housing 21 and with the waterproof ring 24 abutting between the annular flange 251 and the transparent shield 23.

During the reflector housing 22 threadedly engaging with the bulb housing 11, the bulb 12 can be adjusted to locate at the focus of the reflecting concave 222 through testing lighting reflecting effect of the bulb 12 and the reflecting concave 222 of the reflector housing 22. After the bulb 12 is located at the focus of the reflecting concave 222, the bulb housing 11 is fixed at the reflector housing 22. For example, glue is disposed between the thread segment 113 of the bulb housing 11 and the inner thread segment 225 of the reflector housing 22. Thus, after assembly, the bulb 12 always locates at the focus of the reflecting concave for convenient use of the electric torch.

Furthermore, the electrically conductive terminal 121 of the bulb 12 is bent after extending through the bulb hole 111 of the bulb housing 11. Though the bent portion of the terminal 121 is close to the body of bulb 12, the electrically conductive terminal 121 is readily bent due to the recessed portion 123 of the electrically conductive terminal 121, and so the glass shell at the junction of the electrically conductive terminal 121 and the bulb 12 is not exerted with a bending force thereby preventing micro-splits from occurring at the bulb 12 and therefore ensuring the quality of the bulb 12.

Additionally, the center portion of the negative pole of the battery 316 is extremely thin and so the center portion of the negative pole is easily recessed due to an external force (particularly to a CR-123 lithium battery). However, the peripheral portion of the negative pole of the battery 316 is able to bear a larger external force than the center portion of the negative pole. When the battery 316 is exerted with the acceleration of gravity or a shooting recoil, since the recessed annulus 313 abuts against the peripheral portion of the negative pole of the battery 316, the center portion of the negative pole of the battery 316 is exerted with a lower external force only thereby preventing the negative pole from being recessed and so preventing the battery 316 from being in poor electrical connection with the bulb 12.

It is understood that the invention may be embodied in other forms without departing from the spirit thereof. Thus, the present examples and embodiments are to be considered in all respects as illustrative and not restrictive, and the invention is not to be limited to the details given herein.

What is claimed is:

1. An electric torch comprising a bulb holder comprising a bulb housing and a bulb received in the bulb housing, the bulb comprising a first electrically conductive terminal and a second electrically conductive terminal, a recessed portion being formed at the first electrically conductive terminal whereby the first electrically conductive terminal is ground by a file to form the recessed portion which is generally a triangular cutout with a bottom angle about 90 degrees and is easily bent at the recessed portion and;

a head comprising a head housing which comprises a first thread segment at the upper outside surface thereof and a thread segment at the lower inside surface thereof, a reflector housing fixed to the upper portion of the bulb housing and abuttingly received in the head housing, and a head cover, the reflector housing having an arcuate reflecting concave at the upper inside thereof, a through hole being defined in the center of the reflecting concave for extension of the bulb, an inner thread segment being formed at the upper portion of the head cover for engaging with the first thread segment of the head housing; and a body comprising a base, the base comprising an outer thread segment at the upper portion thereof for engaging with the thread segment of the head housing, an upper receiving chamber being defined in the upper portion of the base; a conductive member being received in the bottom of the upper receiving chamber for electrically connecting with a battery in the base.

2. The electric torch as claimed in claim 1, wherein the bulb housing comprises a bulb hole and a bulb housing receiving chamber in communication to the bulb hole.

3. The electric torch as claimed in claim 1, wherein the bulb housing has a thread segment at the upper outside surface thereof, an engaging chamber is defined in the bottom of the reflector housing in communication to the through hole of the reflecting concave, an inner thread segment is formed at the engaging chamber for engaging with the thread segment of the bulb housing.

4. The electric torch as claimed in claim 3, wherein when the bulb locates at the focus of the reflecting concave, glue is disposed between the inner thread segment of the reflector housing and the thread segment of the bulb housing thereby fixing the reflector housing to the bulb housing.

5. The electric torch as claimed in claim 1, wherein the bulb holder comprises an annular metal plate received in a bulb housing receiving chamber of the bulb housing, a through hole is defined in the annular metal plate for extension of the first and second electrically conductive terminals.

6. The electric torch as claimed in claim 5, wherein the bulb holder comprises an insulative sleeve received in a bulb housing receiving chamber of the bulb housing, the insulative sleeve is adjacent to the annular metal plate, an eccentric hole for extension of the second electrically conductive terminal and a sleeve receiving chamber in communication to the eccentric hole are respectively defined in the insulative sleeve.

7. The electric torch as claimed in claim 6, wherein the bulb holder comprises a conductive metal plate received in the insulative sleeve, an eccentric hole is defined in the conductive metal plate for extension of the second electrically conductive terminal.

8. The electric torch as claimed in claim 6, wherein the bulb holder comprises an inner metal sleeve received in the insulative sleeve, an inner sleeve receiving chamber is defined in the inner metal sleeve.

9. The electric torch as claimed in claim 8, wherein the inner sleeve receiving chamber of the inner metal sleeve receives an inner spring therein.

10. The electric torch as claimed in claim 1, wherein an outer spring abuts between the bulb housing and the upper receiving chamber of the base.

11. The electric torch as claimed in claim 1, wherein the head housing further comprises a second thread segment, the second thread segment engages with a positioning annulus formed at the bottom of the head cover.

12. The electric torch as claimed in claim 1, wherein at least one annular recess is defined in the outside surface of the head housing for receiving a waterproof ring.

13. The electric torch as claimed in claim 1, wherein an abutting chamber is defined in the upper inside of the head housing for abuttingly receiving the reflector housing.

14. The electric torch as claimed in claim 13, wherein the reflector housing has an abutting annulus at the upper outside surface thereof for abutting against the abutting chamber.

15. The electric torch as claimed in claim 1, wherein a transparent shield is disposed at the top of the reflector housing, an annular flange inwardly extends from the upper portion of the head cover, a waterproof ring is disposed between the annular flange and the transparent shield.

16. The electric torch as claimed in claim 1, wherein at least one annular recess is defined in the base below the portion of the base threadedly engaging with the head housing, each annular recess receives a waterproof ring.

17. The electric torch as claimed in claim 16, wherein the bottom of the upper receiving chamber of the base threadedly engages with the annular recess for positioning the conductive member.

18. The electric torch as claimed in claim 1, wherein the bottom of the conductive member engagingly receives a spring for abutting against the battery.

* * * * *